US009687137B2

(12) United States Patent
Boyer et al.

(10) Patent No.: US 9,687,137 B2
(45) Date of Patent: Jun. 27, 2017

(54) DIVERTER FOR SELECTIVE FLUID FLOW IN A DISHWASHING APPLIANCE

(71) Applicant: General Electric Company, Schenectady, NY (US)

(72) Inventors: Joel Charles Boyer, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 150 days.

(21) Appl. No.: 14/738,976

(22) Filed: Jun. 15, 2015

(65) Prior Publication Data

US 2016/0360945 A1 Dec. 15, 2016

(51) Int. Cl.
*A47L 15/42* (2006.01)

(52) U.S. Cl.
CPC ..... *A47L 15/4221* (2013.01); *A47L 15/4219* (2013.01)

(58) Field of Classification Search
None
See application file for complete search history.

(56) References Cited

U.S. PATENT DOCUMENTS

| | | | |
|---|---|---|---|
| 5,899,433 | A | 5/1999 | Kim |
| 2009/0090400 | A1 | 4/2009 | Burrows |
| 2010/0139698 | A1 | 6/2010 | Gnadinger et al. |

FOREIGN PATENT DOCUMENTS

DE 102012215683 A1 * 3/2014

OTHER PUBLICATIONS

English machine translation of DE102012215683A1.*

* cited by examiner

*Primary Examiner* — Michael Barr
*Assistant Examiner* — Jason Riggleman
(74) *Attorney, Agent, or Firm* — Dority & Manning, P.A.

(57) ABSTRACT

A diverter for a dishwasher appliance that can be used to provide more options for directing fluid among various spray arms or spray devices in a dishwasher appliance. The diverter can be used e.g., to select between fluid delivery to both the upper and lower spray arm assemblies or to both the upper and middle spray arm assemblies.

16 Claims, 8 Drawing Sheets

DIVERTER FOR SELECTIVE FLUID FLOW IN A DISHWASHING APPLIANCE

FIELD OF THE INVENTION

The subject matter of the present invention relates generally to a diverter for controlling the flow of fluid in a dishwasher appliance between various spray arms or other spray devices.

BACKGROUND OF THE INVENTION

During wash and rinse cycles, dishwashers typically circulate a fluid through the wash chamber and over articles such as pots, pans, silverware, and other cooking utensils using spray arms or other devices named by their wash chamber position including, e.g., a lower spray arm (LSA), middle spray arm (MSA), and upper spray arm (USA). The fluid typically recirculates through multiple spray arms and/or other spray devices and may include separate supply conduits or channels to one or more of such devices. During a given cycle, the fluid is collected at or near the bottom of the wash chamber and pumped back into the chamber through e.g., nozzles in the spray arms and other openings that direct the fluid against the articles to be cleaned or rinsed.

Depending on wash and rinse cycle selection, one or more of the spray arms may be activated in order to perform certain cleaning and rinsing operations. It is advantageous to be able to selectively operate certain dishwasher spray arms or other spray devices in order to achieve higher energy efficiency, quieter running, and improved cleaning. Typically, a dishwashing appliance does not operate all spray arms or spray devices simultaneously because of e.g., the energy and water that would be required.

In certain conventional dishwashing appliances, complex valve assemblies, multi-channel conduits, and/or other mechanisms may be used to allow for selection of which spray arms or spray devices will be activated. Such constructions and mechanisms can add cost and complexity to the dishwashing appliance. Alternatively, some dishwashing appliances may switch between supplying fluid to the lower spray arm assembly and supplying fluid to both the upper spray arm and middle spray arm simultaneously. Depending on their construction, such appliances may also consume energy, require significant volumes of water to operate properly, and/or limit the ability to control which part of the dishwashing appliance receives the recirculated wash or rinse fluids.

Accordingly, a diverter that provides more options for controlling which specific spray arms and/or spray devices received fluid in a dishwasher would be useful. Such a diverter that can be actuated without employing complex mechanisms such as e.g., a solenoid would be useful. Such a diverter that does not increase the overall volume of fluid required to operate the appliance would also be useful.

BRIEF DESCRIPTION OF THE INVENTION

The present invention relates to a diverter for a dishwasher appliance that can be used to provide more options for directing fluid among various spray arms or spray devices in a dishwasher appliance. In an exemplary embodiment, the diverter can be used to select between fluid delivery to both the upper and lower spray arm assemblies or to both the upper and middle spray arm assemblies. The diverter includes a normally-closed valve that can open at a predetermined pressure to feed the middle spray arm and upper spray arm or can be closed to limit the flow to an upper and lower spray arm assembly. The diverter may be used with other spray devices and configurations as well. Aspects and advantages of the invention will be set forth in part in the following description, or may be obvious from the description, or may be learned through practice of the invention.

In another exemplary embodiment of the present invention, a dishwashing appliance is provided that includes a cabinet defining a wash chamber for the receipt of articles for washing, the cabinet comprising a pair of opposing side walls, a top wall, and a rear wall. A pump is configured for the receipt of a fluid to be recirculated into the wash chamber of the cabinet. A main supply conduit extending along the rear wall is configured to receive fluid from the pump. The main supply conduit comprises an exit port for the flow of fluid from the main supply conduit. A diverter is disposed over the exit port of the main supply conduit including a valve moveable between i) a closed position where the valve is seated against the exit port so as to block fluid flow from the main supply conduit and ii) an open position where the valve is positioned away from the exit port when fluid pressure at the exit port exceeds a predetermined value so as to allow fluid flow from the main supply conduit and into the wash chamber.

In another exemplary aspect, the present invention provides a dishwashing appliance having a wash chamber for the receipt of articles for washing, an upper spray device positioned in the wash chamber, a middle spray device positioned in the wash chamber below the upper spray device, and a lower spray device position in the wash chamber below the middle spray device.

A pump is configured for the receipt of a fluid to be recirculated into the wash chamber of the cabinet. A main supply conduit provides fluid communication between the pump and the middle and upper spray devices. The main supply conduit includes an exit port for the flow of fluid from the main supply conduit. A diverter includes a valve moveable between i) a closed position where the valve is seated against the exit port so as to block fluid flow from the main supply conduit to the middle spray device and ii) an open position where the valve is positioned away from the exit port when fluid pressure at the exit port exceeds a predetermined value so as to allow fluid flow from the main supply conduit to the middle spray device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
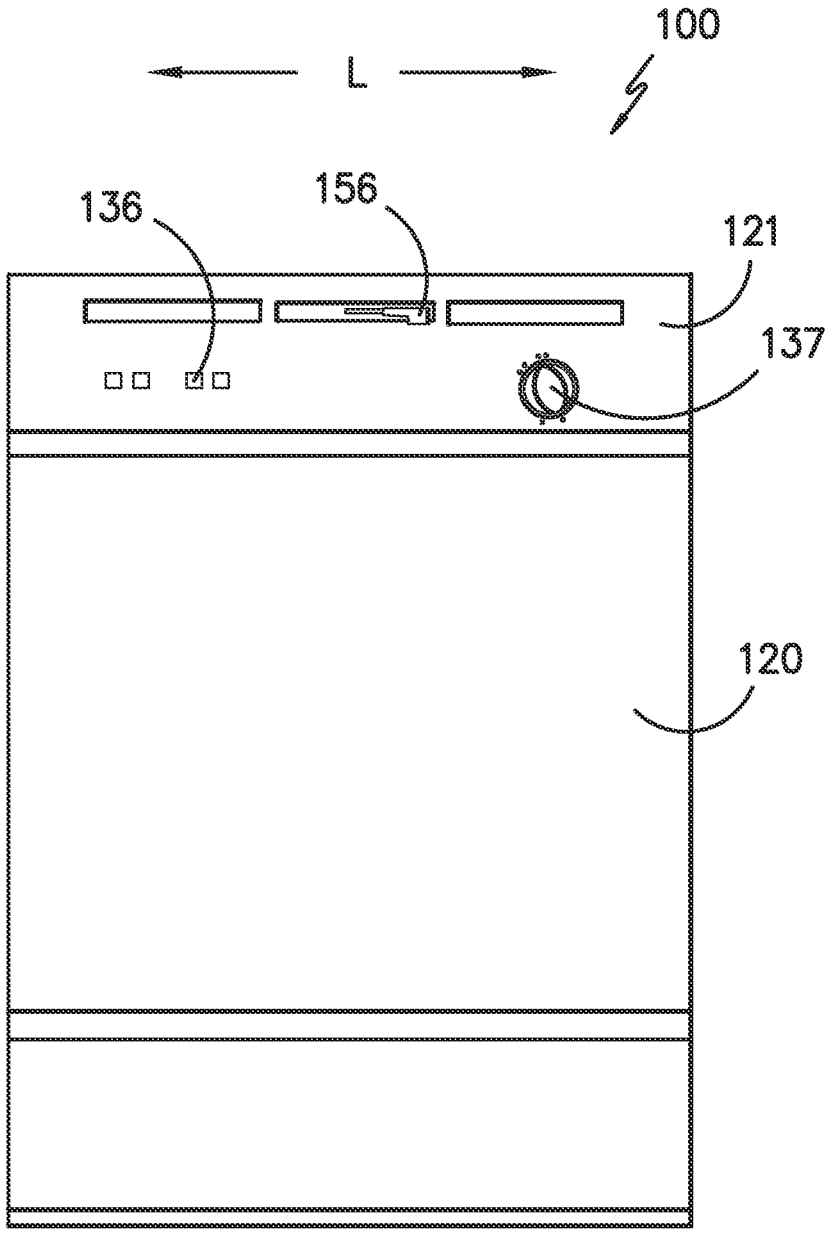
FIG. 1 provides a front view of an exemplary embodiment of a dishwashing appliance as may be used with the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements that were retained by the articles after completion of the wash cycle. The term "fluid" refers to a liquid used for washing and/or rinsing the articles and is typically made up of water that may include other additives such as detergent or other treatments.

Figure 2:
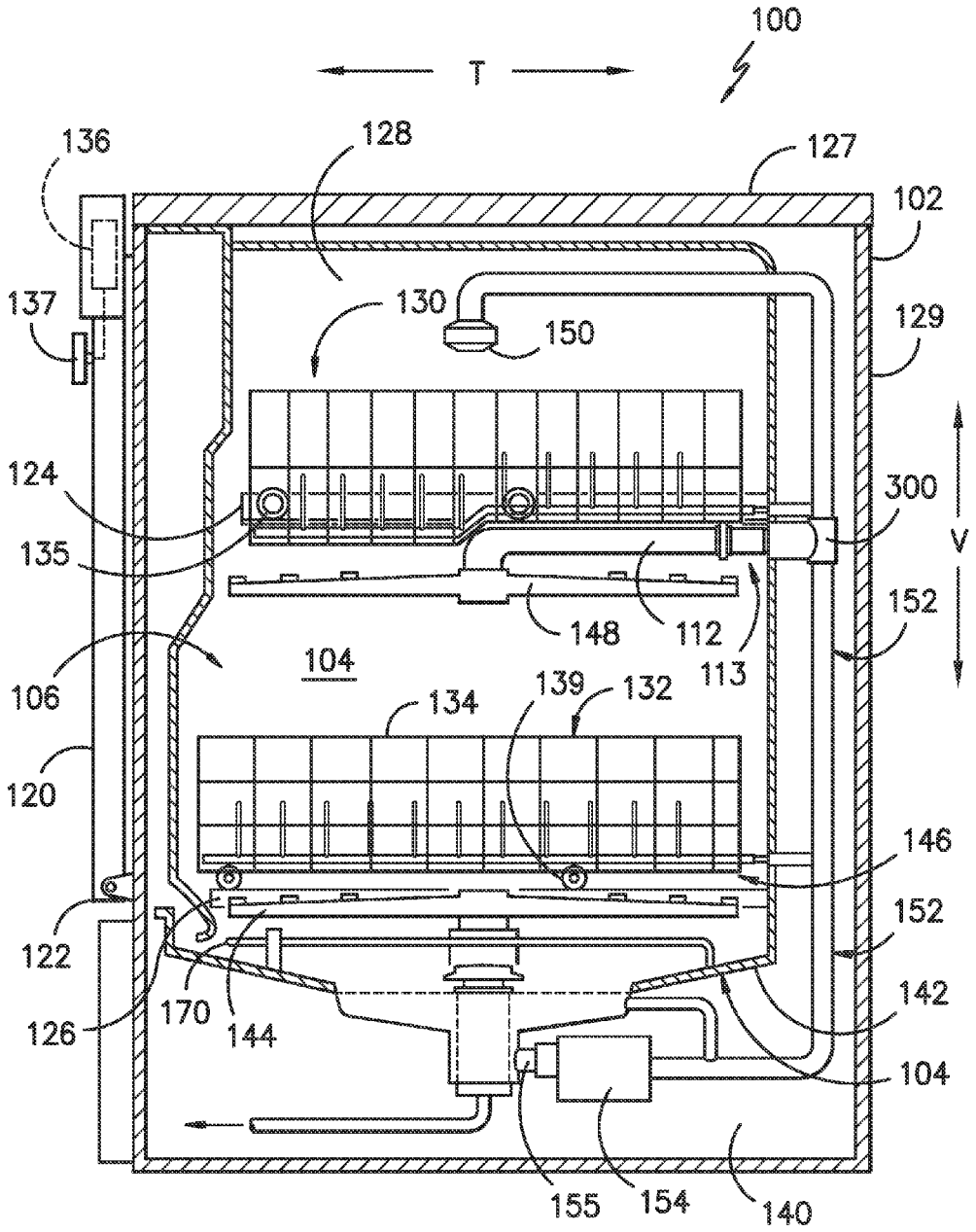
FIG. 2 is a cross-sectional view of the exemplary embodiment of a dishwashing appliance shown in FIG. 1.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operations, and a horizontal open position for loading and unloading of articles from the dishwasher. Latch 156 is used to lock and unlock door 120 for access to wash chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130. Although a spray assembly 150 is shown, an upper spray arm assembly may be used as well. Other fluid emitting devices for cleaning articles may be used at the lower, middle, and/or upper positions as well.

The lower and mid-level spray-arm assemblies 144, 148 and the upper spray assembly 150 are in fluid communication with a pump 154 and a main supply conduit 152 for circulating fluids (e.g., wash or rinse) in the tub 104. The main supply conduit 152 is served by a recirculation pump 154 positioned in a machinery compartment 140 located below the tub sump portion 142 (i.e., bottom wall) of the tub 104, as generally recognized in the art. Pump 154 receives fluid from sump 142 to provide a flow to the main supply conduit 152. A heating element 170 can be used to provide heat during e.g., a drying cycle.

Each spray-arm assembly 144, 148 includes an arrangement of discharge ports or orifices for directing washing fluid received from pump 154 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 using fluid from pump 154 provides coverage of dishes and other dishwasher contents with a washing spray. Other configurations of spray assemblies may be used as well.

The middle spray-arm assembly 148 is releasably connected with fluid supply conduit 152 by way of a diverter 300 as further described herein. Specifically, as rack 130 is moved in and out of chamber 106, fluid supply conduit 112 releasably connects or disconnects from diverter 300. Other configurations may also be used.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120.

Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, different spray devices and spray arm assemblies may be used, and other differences may be applied as well.

Figure 7:
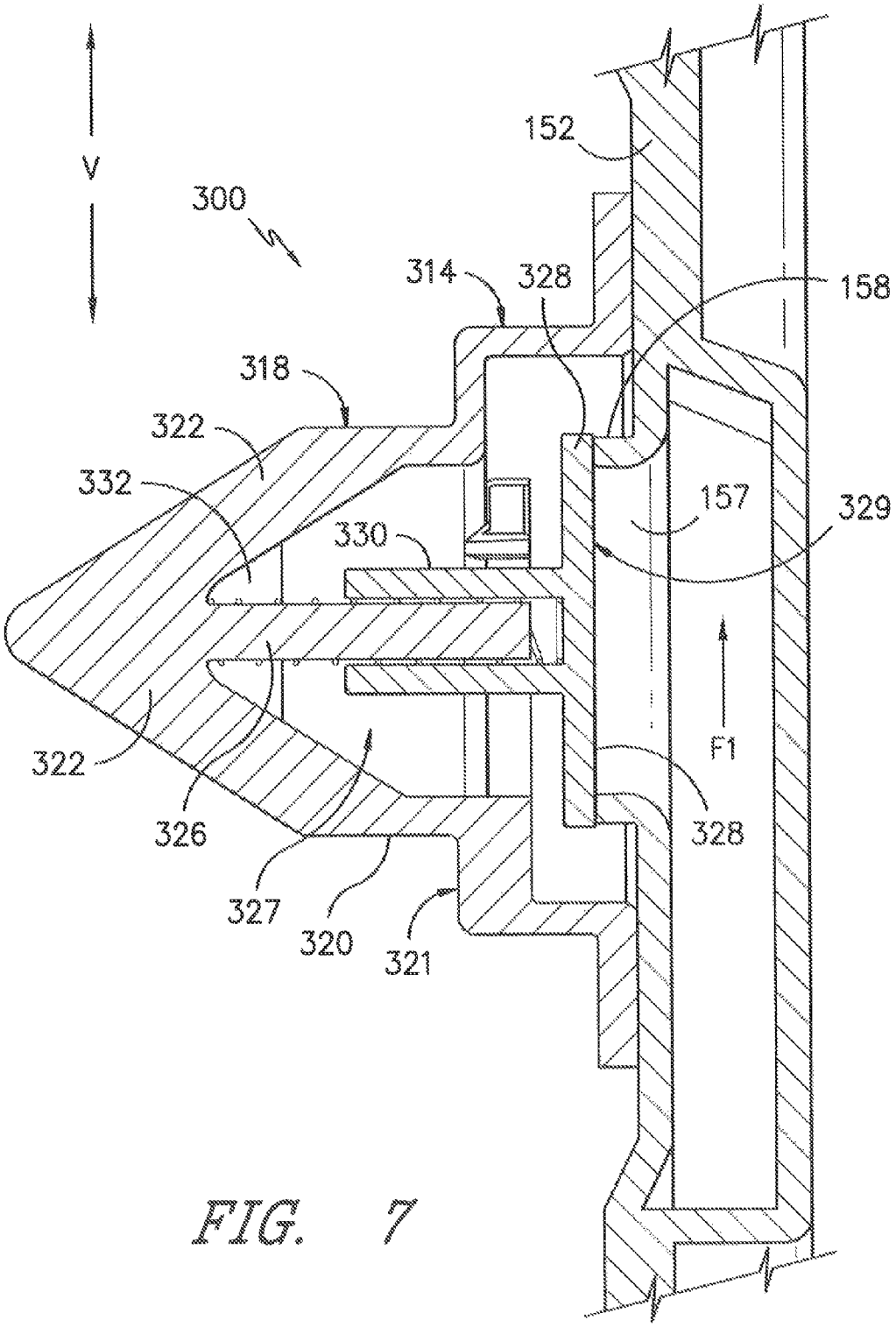
FIG. 7 is a side view of the exemplary diverter of FIG. 3 in a closed position.

As seen in FIG. 2, the main supply conduit 152 extends along the rear wall 129 of the cabinet 102 having a top wall 127 and configured to receive fluid from the pump 154 that is supplied at the pump inlet 155. As seen in FIG. 7, the main supply conduit 152 has an exit port 156 for the flow of fluid from the main supply conduit 152. The main supply conduit 152 has an annular lip 158 surrounding the exit port 156 and protruding towards a valve 302.

Figure 3:
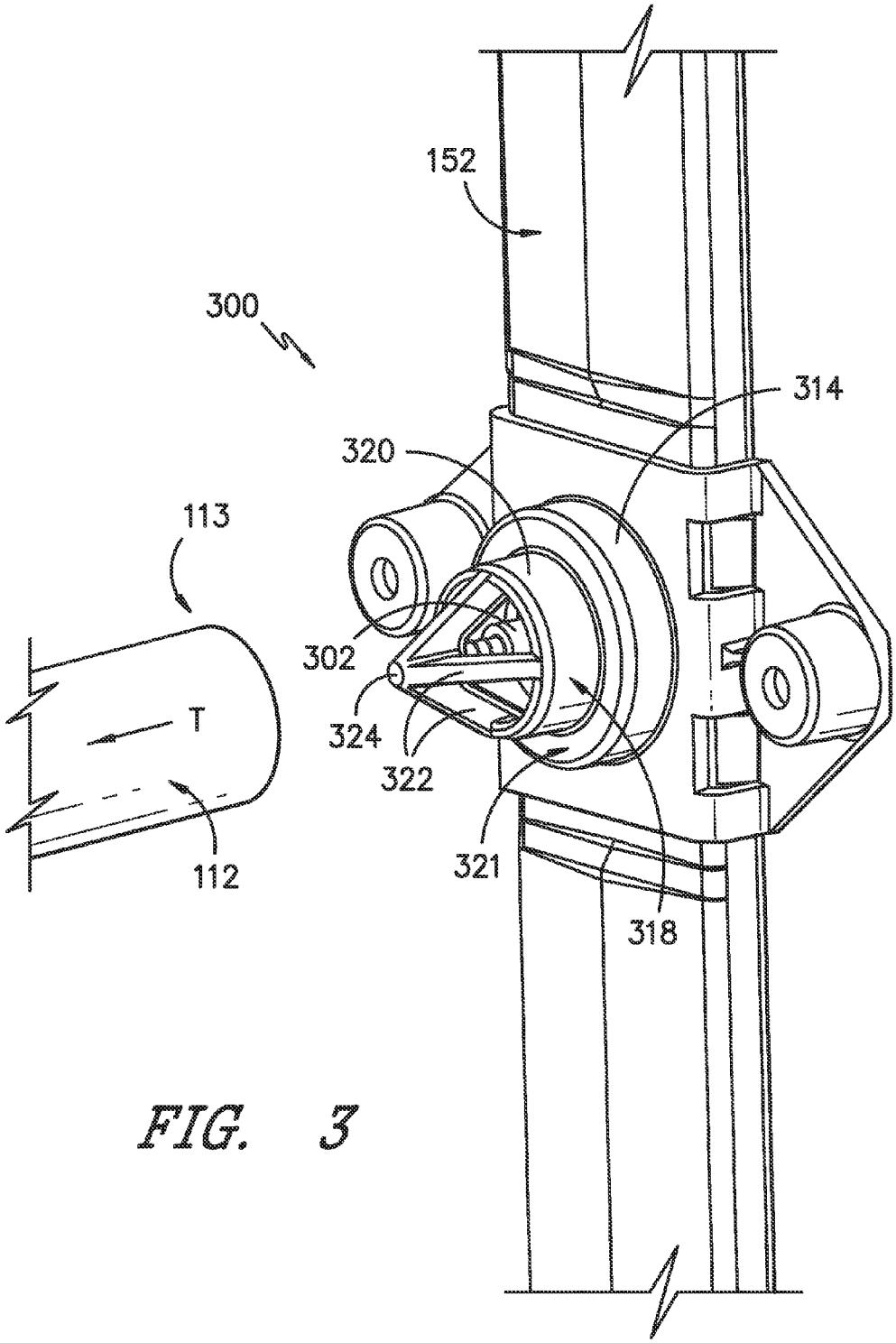
FIG. 3 is a perspective view of an exemplary embodiment of a diverter and valve of the present invention.

Referring now to FIG. 3, an exemplary embodiment of a diverter 300 is located on the main supply conduit 152. The diverter 300 is mounted over the exit port 156 of the main supply conduit 152. The diverter 300 has a valve 302 moveable between i) a closed position (FIG. 7) where the valve is seated against the exit port 156 so as to block fluid flow from the main supply conduit 152 and ii) an open position (FIGS. 5 and 6) where the valve 302 is positioned away from the exit port 156 when fluid pressure at the exit port 156 exceeds a predetermined value so as to allow fluid flow from the main supply conduit 152 and into the wash chamber 106.

Figure 4:
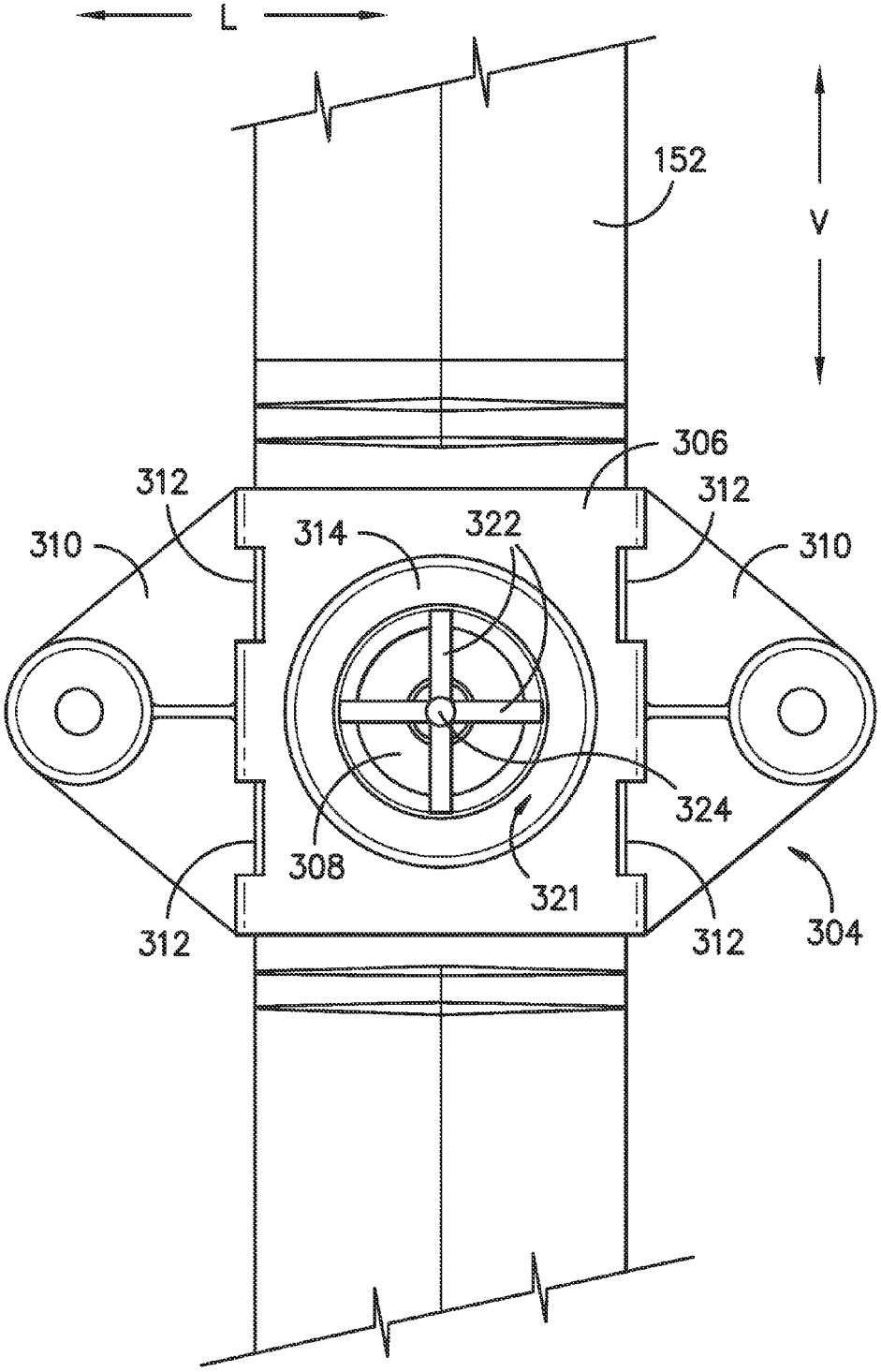
FIG. 4 is a front view of the exemplary diverter of FIG. 3.

As shown in FIG. 4, the diverter further has a diverter housing 304 into which the valve 302 is received. The diverter housing 304 has a base 306 positioned adjacent to the main supply conduit 152 and defining an opening 308 positioned over the exit port 156. A pair of legs 310 are positioned on opposing sides of the base 306, the legs 310 are configured for attachment to the base 306 and to the main supply conduit 152. A plurality of clips 312 are positioned on each of the legs 310 and are configured for attaching the base 306 to the main supply conduit 152. Legs 310 include opening 311 for fastening diverter 300 to e.g., rear wall 129.

Figure 5:
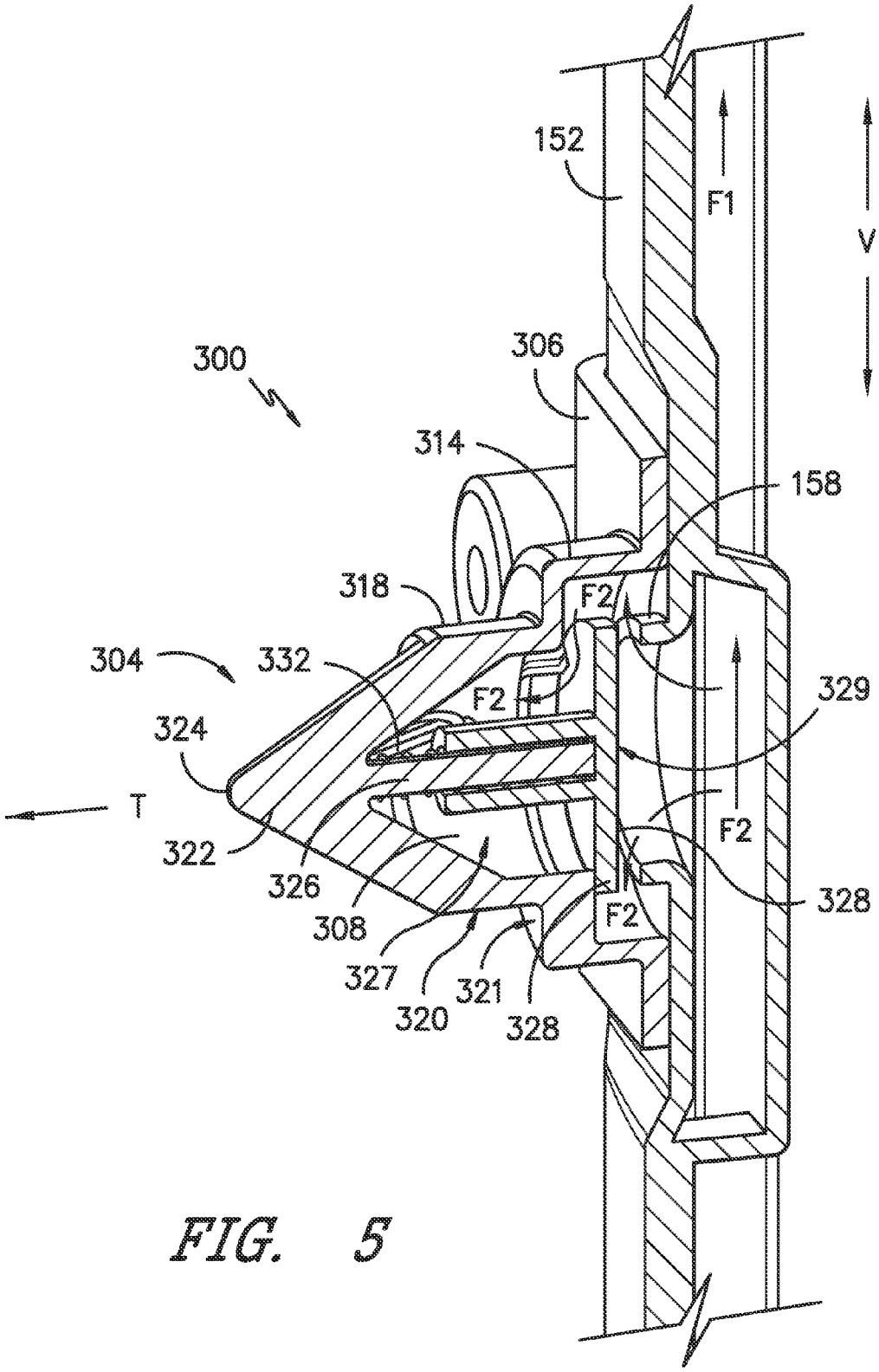
FIG. 5 is a cross-sectional view of the exemplary diverter of FIG. 3.
Figure 6:
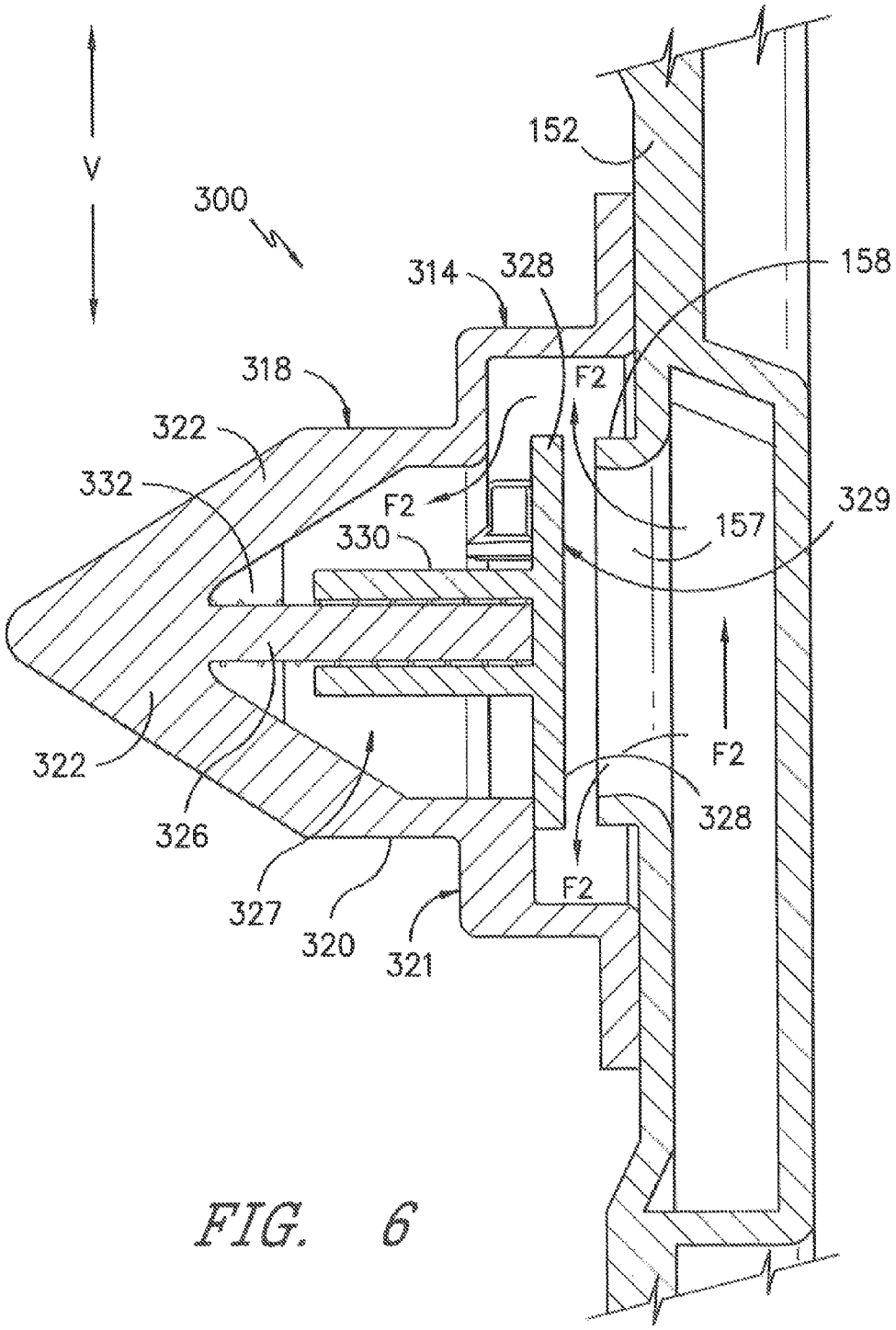
FIG. 6 is a side view of the exemplary diverter of FIG. 3 in an open position.

In FIGS. 5 and 6, the diverter 300 is shown with the valve 302 in an open position wherein the fluid pressure at the exit port 156 exceeds the force to overcome the biasing member 332 and passes recirculating fluid to the spray arm conduit 112 as shown by arrows F2. When diverter 300 is in the closed position as shown in FIG. 7, fluid cannot travel into spray arm 316 and, instead, travels as shown by arrows F1. The diverter housing 304 further has an annular stop 314 extending from the base 306 into the wash chamber 106 and configured for releasable connection with spray arm conduit 112 (FIGS. 2 and 3).

An alignment boss 318 extends from the annular stop 314 along transverse direction T into the wash chamber 106 for complementary receipt of the spray arm conduit 112. The alignment boss 318 further has a circular neck 320 extending from the annular stop 314 along transverse direction T into the wash chamber 106. A plurality of ribs 322 extend from the circular neck 320 and terminate at a common interconnected central tip joint 324.

As rack 130 is moved into chamber 106, distal end 113 (FIGS. 2, 3, and 8) of conduit 112 is aligned with boss 318 and engages ribs 322. Ribs 322 operate to center conduit 112 onto boss 318 as rack 130 and conduit 112 are moved into chamber 106 along transverse direction T. Eventually, distal end 113 of conduit 112 abuts with annular surface 321 defined by annular stop 314. As shown, for this embodiment, annular surface 321 is coplanar with vertical direction V.

The alignment boss 318 further has a post 326 contained within a chamber 327 (FIGS. 5 and 6) formed by ribs 322. Post 326 extending inward from the central tip joint 324 along transverse direction T towards the exit port 156. Valve 302 is slidable between the first and second position along the post 326.

Figure 8:
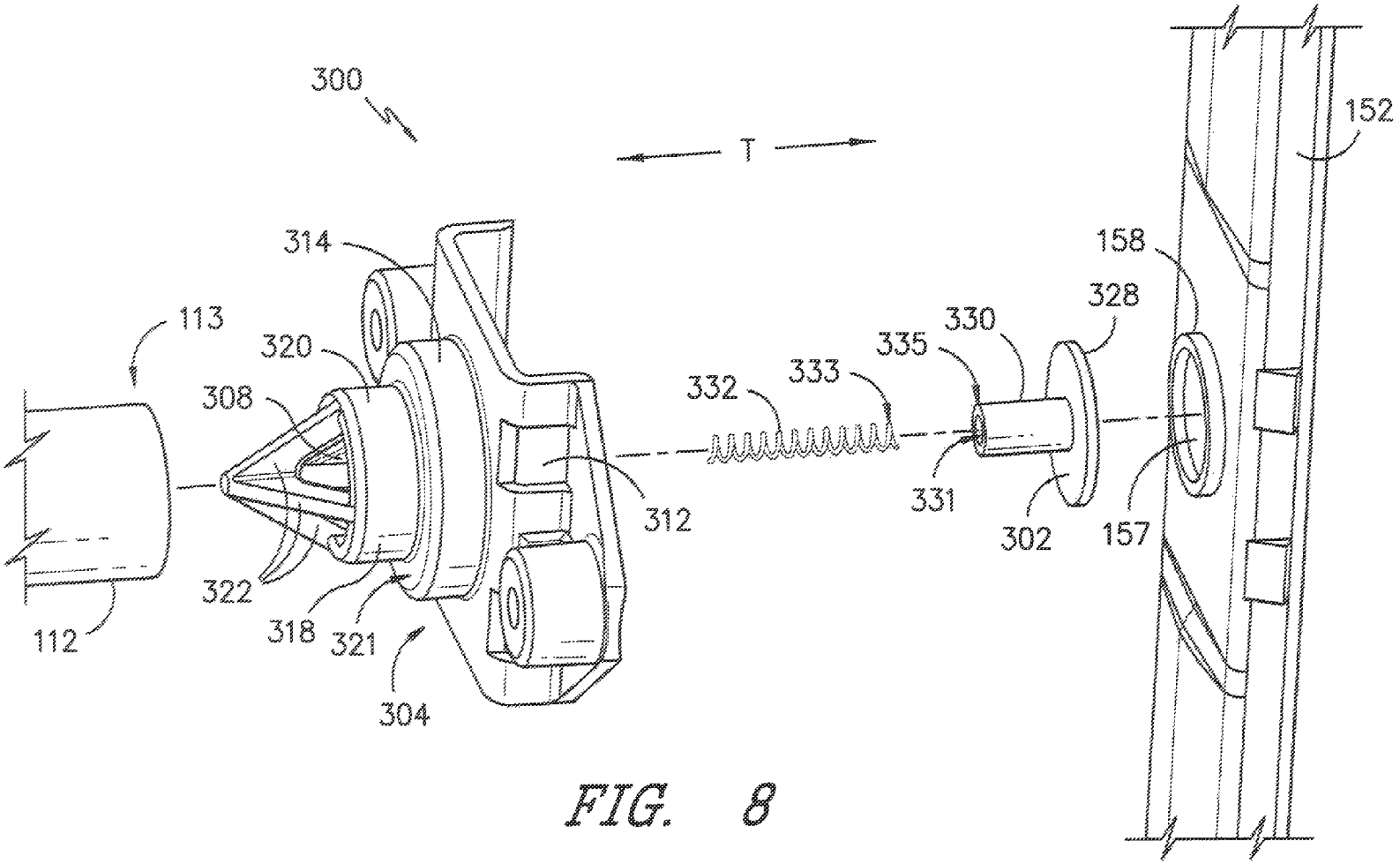
FIG. 8 is an exploded view of the exemplary diverter of FIG. 3.

As shown in FIG. 8, the valve 302 has a circular seat 328 for positioning over the exit port 156 to block fluid flow. More particularly, when valve 302 is in a closed position, the sealing surface 329 on seat 328 of valve 302 rests against annular lip 158 to provide a fluid seal as shown in FIG. 7. When no fluid pressure is provided against the sealing surface 329 of seat 328, valve 302 maintains this closed position.

More specifically, valve 302 includes a stem 330 that projects orthogonally from the circular seat 328 and slidably connects with the post 326. The stem 330 is cylindrically-shaped and defines an opening 331 into which the post 326 is slidably received such that valve 302 slide between the open and closed position along post 326. Without sufficient fluid pressure, the biasing member 332 urges the valve 302 towards the closed position of FIG. 7. Upon experiencing enough fluid pressure (referred to as a "predetermined value of fluid pressure") in conduit 152, such fluid pressure will act against sealing surface 329 to provide a force sufficient to overcome biasing member 332 and cause valve 302 to move to an open position of FIGS. 5 and 6.

For example, the biasing member 332 may be a helical spring disposed around the post 326 and having a distal end 333 that presses against a distal end 335 of the stem 330. Although shown as circular, seat 328 may have other shapes as well.

An exemplary method of operation will now be described. Using the teachings disclosed herein, one or ordinary skill in the art will understand that other exemplary methods of operation of diverter 300 may be used as well.

Accordingly, in one exemplary aspect, dishwashing appliance 100 operates between a first mode and a second mode. In the first mode, fluid (e.g., wash or rinse) is fed to the lower spray arm 144. In this mode, fluid pressure at exit port 156 is insufficient to overcome biasing member 332—so no fluid flows from middle spray arm 148. Fluid may flow from upper spray assembly 150. In the second mode, fluid is not fed to the lower spray arm. As such, fluid pressure at exit port 156 is sufficient to overcome biasing member 332, which allows fluid to flow form middle spray arm 148.

In one exemplary embodiment, when a predetermined value of fluid pressure at the exit port 156 is in the range of about 2 to about 6 pounds per square inch, the biasing member 332 allows the valve 302 to open and pass recirculating fluid through the exit port 156 into the spray arm conduit 112. In one exemplary aspect, the predetermined value of fluid pressure at the exit port 156 is about 4 pounds per square inch. Other predetermined values may be used as well. The predetermined value at which the helical spring 332 is opened can be determined e.g., based on the Hooke's law constant used to select spring 332.

Additionally, diverter 300 may be used at other locations along main supply conduit 152 as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet defining a wash chamber for the receipt of articles for washing, the cabinet comprising a pair of opposing side walls, a top wall, and a rear wall;

a pump configured for the receipt of a fluid to be recirculated into the wash chamber of the cabinet;

a main supply conduit extending along the rear wall and configured to receive fluid from said pump, the main supply conduit comprising an exit port for the flow of fluid from the main supply conduit; and a diverter having disposed over the exit port of the main supply conduit, the diverter comprising:

a diverter housing comprising a base positioned adjacent to the main supply conduit and defining an opening positioned over the exit port, a pair of legs positioned on opposing sides of the base, the legs configured for attachment to the base and to the main supply conduit, and a plurality of clips positioned on the legs and configured for attaching the base to the main supply conduit;

a valve received in the diverter housing, the valve moveable between i) a closed position where the valve is seated against the exit port so as to block fluid flow from the main supply conduit and ii) an open position where the valve is positioned away from the exit port when fluid pressure at the exit port exceeds a predetermined value so as to allow fluid flow from the main supply conduit and into the wash chamber.

2. A dishwashing appliance as in claim 1, wherein the diverter housing further comprises an annular stop extending from the base into the wash chamber and configured for abutting with a spray arm conduit.

3. A dishwashing appliance as in claim 2, wherein the diverter housing further comprises an alignment boss extending from the annular stop into the wash chamber for complementary receipt of the spray arm conduit.

4. A dishwashing appliance as in claim 3, wherein the alignment boss further comprises a circular neck extending from the annular stop into the wash chamber.

5. A dishwashing appliance as in claim 4, wherein the alignment boss further comprises a plurality of ribs extending from the circular neck and terminating at a common interconnected central tip joint.

6. A dishwashing appliance as in claim 5, wherein the alignment boss further comprises a post extending inward from the central tip joint towards the exit port, wherein the valve is slidable between the first and second position along the post.

7. A dishwashing appliance as in claim 6, wherein the valve comprises:

a circular seat for positioning over the exit port to block fluid flow; and a stem projecting orthogonally from the circular seat and slidably connecting with the post.

8. A dishwashing appliance as in claim 7, wherein the stem is cylindrically-shaped and defines an opening into which the post is slidably received.

9. A dishwashing appliance as in claim 6, further comprising a biasing member for urging the valve towards the closed position.

10. A dishwashing appliance as in claim 9, wherein the biasing member comprises a helical spring disposed around the post.

11. A dishwashing appliance as in claim 1, wherein the predetermined value of fluid pressure at the exit port is in the range of about 2 to about 6 pounds per square inch.

12. A dishwashing appliance as in claim 1, wherein the predetermined value of fluid pressure at the exit port is about 4 pounds per square inch.

13. A dishwashing appliance as in claim 1, wherein the main supply conduit comprises an annular lip surrounding the exit port and protruding towards the valve.

14. A dishwashing appliance, comprising:

a wash chamber for the receipt of articles for washing;

an upper spray device positioned in the wash chamber;

a middle spray device positioned in the wash chamber below the upper spray device;

a lower spray device position in the wash chamber below the middle spray device;

a pump configured for the receipt of a fluid to be recirculated into the wash chamber of the cabinet;

a main supply conduit providing fluid communication between the pump and the middle and upper spray devices, the main supply conduit comprising an exit port for the flow of fluid from the main supply conduit; and a diverter comprising a valve moveable between i) a closed position where the valve is seated against the exit port so as to block fluid flow from the main supply conduit to the middle spray device and ii) an open position where the valve is positioned away from the exit port when fluid pressure at the exit port exceeds a predetermined value so as to allow fluid flow from the main supply conduit to the middle spray device.

15. A dishwashing appliance as in claim 14, wherein the predetermined value of fluid pressure is in the range of about 2 to about 6 pounds per square inch.

16. A dishwashing appliance as in claim 14, wherein the predetermined value of fluid pressure is about 4 pounds per square inch.

* * * * *